US005344012A

United States Patent [19]

Matthews

[11] Patent Number: 5,344,012

[45] Date of Patent: Sep. 6, 1994

[54] SOCKET CADDY

[76] Inventor: James R. Matthews, 35391 Wanki Ave., Wildomar, Calif. 92595

[21] Appl. No.: 116,578

[22] Filed: Sep. 7, 1993

[51] Int. Cl.[5] ..... B65D 85/20

[52] U.S. Cl. ..... 206/372; 206/378; 206/818

[58] Field of Search ..... 206/376, 377, 378, 379, 206/443, 818, 373

[56] References Cited

U.S. PATENT DOCUMENTS

| | | | |
|---|---|---|---|
| 3,405,377 | 10/1968 | Pierce | 206/378 X |
| 4,150,746 | 4/1979 | Buglione | 206/378 X |
| 4,421,230 | 12/1983 | Stanton | 206/378 |
| 4,711,353 | 12/1987 | Rozmestor | 206/378 |
| 4,770,297 | 9/1988 | Chang | 206/379 |
| 5,080,230 | 1/1992 | Winnard | 206/378 X |
| 5,133,455 | 7/1992 | Chow | 206/378 X |

*Primary Examiner*—Jacob K. Ackun, Jr.
*Attorney, Agent, or Firm*—Roger A. Marrs

[57] ABSTRACT

A caddy for organizing the storage of a plurality of wrench sockets is disclosed herein having a support member with a flat planar plate provided with a plurality of openings for insertably receiving a variety of sockets for storage. The plate openings are arranged in a predetermined order of socket sizes in rows and columns with raised dimensional values adjacent each opening corresponding to a particular socket size. A peripheral flange carried on the plate serves as a standoff for raising the support member plate above a supporting tool box tray or the like. A magnetic pad or layer may be disposed on the tray below the plate for magnetically attracting the sockets for releasably holding the sockets in place. Each opening includes a pliable tab intended to releasably grip a respective socket in the opening.

1 Claim, 1 Drawing Sheet

SOCKET CADDY

BACKGROUND OF THE INVENTION

1. Field of the Invention

The present invention relates to the field of tool caddies, and more particularly to a novel caddy for organizing a variety of wrench sockets in an orderly manner and which includes means for removably retaining each individual socket in a respective storage opening so that vibration and inadvertent jarring will not dislodge the sockets from their storage position.

2. Brief Description of the Prior Art

In the past, it has been the conventional practice to store a variety of sockets in a tool box by either randomly placing the sockets in a particular location or by employing a tapered organizer permitting a multiplicity of sockets to be placed between the tapered walls which not only places the sockets in an orderly manner but arranges them according to size matching the taper of the walls. Other means have been employed for storing sockets which may include special apertures in the tray of a tool box so that the sockets may be placed in the aperture for storage. Although these prior attempts are useful for storing a multiplicity of sockets, problems and difficulties have been encountered which stem largely from the fact that undesired vibrations or unusual jarring of the tool box will cause the dislodgement of the respective sockets from their organized location. Such vibration and jarring can occur as the tool box is carried from place to place or transported from one area to another. Also, a further problem resides from the fact that there is no indicia or graphic representation of socket size so that a random arrangement of the sockets is produced even when an orderly channeled or tapered device is employed.

Therefore, a long-standing need has existed to provide a novel organizer or caddy for holding a plurality of different sized wrench sockets in such a manner that it may readily be transported from one place to another, such as in a tool box, without dislodgement due to vibration or jarring. Also, it is desirable to provide a means for identification of the respective sockets since each one is of a different size.

SUMMARY OF THE INVENTION

Accordingly, the above problems and difficulties are overcome by the present invention which provides a novel caddy for organizing a plurality of various wrench sockets, which comprises a plate having a plurality of openings or holes formed therein for insertably receiving the respective sockets. The holes or openings are arranged in rows and columns across the flat planar face of the plate and may include raised indicia adjacent to each one of the holes or openings so as to identify the socket by size when it is placed into the hole or opening. Also, means are provided for retaining the respective sockets for storage in the hole or opening that may take the form of tabs or nubs placed so that they slightly project into the hole or opening whereby an interference fit is experienced when the socket is placed into the hole or opening. Such an interference fit is yieldable so that the sockets may be readily removed when desired. Another form of holding the sockets in their storage position resides in the provision of a magnetic layer or panel immediately under the storage plate which generates a magnetic field sufficient to yieldably hold the sockets in position. A downwardly depending flange is provided about the periphery of the plate serving as a stand-off so that the plate may be supported in the tray of a tool box or the like, creating a space between the underside of the plate and the supporting surface on which the stand-off is resting.

Therefore, it is among the primary objects of the invention to provide a novel means for storing a variety of wrench sockets in an orderly and organized manner so that the respective sockets will remain in their storage position even though the plate is subjected to vibration and jarring.

Another object of the present invention is to provide a means for releasably holding a variety of wrench sockets in an organized manner whereby means are employed for yieldably holding each respective socket in place. Such means may take the form of an interference nub, tab or the like, or it may take the form of a magnetic layer or panel in close proximity to the sockets.

Yet another object of the present invention is to provide a novel means for releasably holding a plurality of sockets in position on a supporting plate which may employ yieldable nubs, tabs or the like as well as magnetic means so that the sockets will not fall or otherwise be dislodged even though the plate is subjected to vibration and jarring.

Still a further object of the present invention is to provide a novel means for storing a variety of sockets of different sizes and which includes indicia for identifying the respective size of each socket in the plurality.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the a-companying drawings in which:

DESCRIPTION OF THE PREFERRED EMBODIMENT

Figure 1:
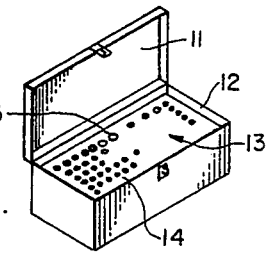
FIG. 1 is a brief perspective view showing a tool box supporting the novel tool caddy of the present invention.

Referring to FIG. 1, a conventional tool box is indicated by numeral 10 which includes a lid 11 that is illustrated in its open position in order to expose a tool tray 12. The tray 12 is illustrated as supporting the tool socket caddy of the present invention which is illustrated in general by the numeral 13. The caddy is employed for organizing a plurality of wrench sockets which are of varying sizes and the sockets are placed on a plate 14 within holes or openings, such as opening 15. As is the conventional practice, the individual socket may include a shoulder on which the socket is supported when introduced into the hole 15 or, if the socket is smooth sided, the bottom of the socket will rest on the bottom of the tray 12 while the uppermost portion of the socket will reside above the plate 14.

Figure 2:
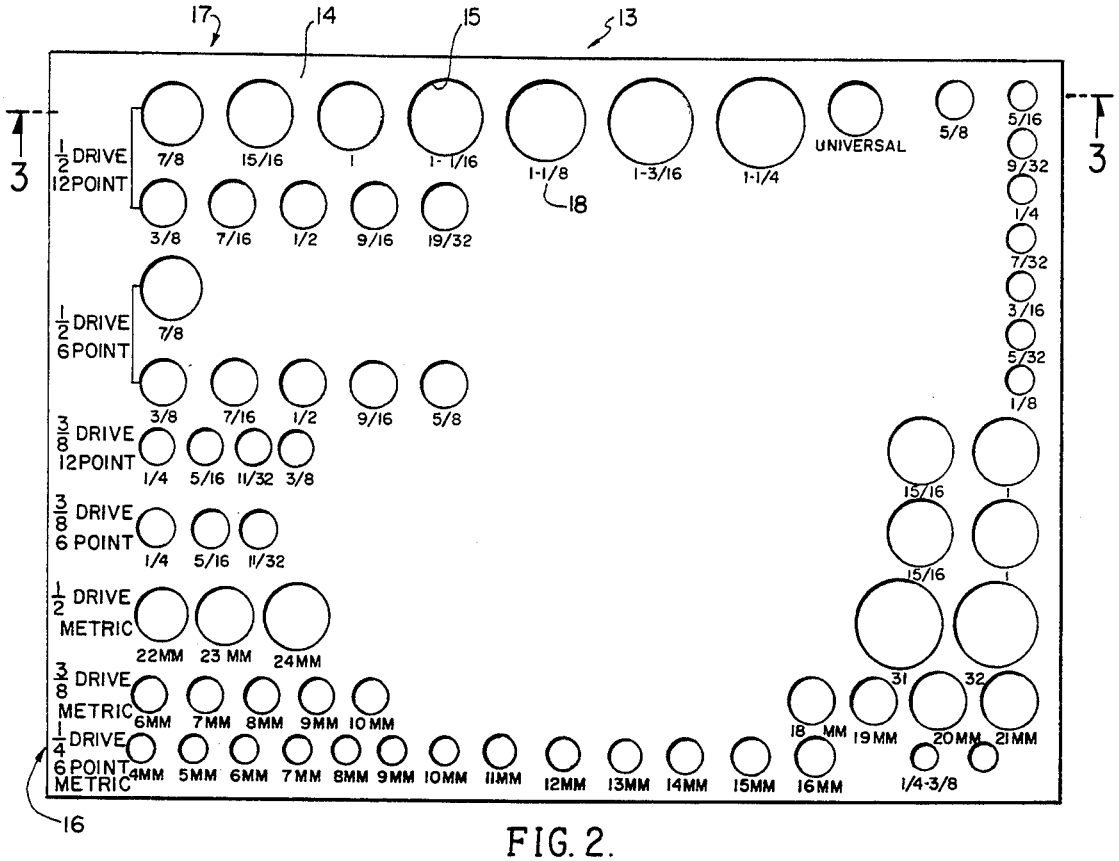
FIG. 2 is an enlarged top plan view of the tool caddy used in the invention of FIG. 1.

Referring now in detail to FIG. 2, the novel caddy 13 is illustrated and it can be seen that the openings or holes 15 are arranged in rows and columns such as indicated by arrows 16 and 17 respectively. Each of the openings is of a different diameter in order to accommodate the variety of sizes of which a wrench socket set is composed. Also, it is to be noted that each of the respective openings includes a raised indicia, such as the raised numerals 1-⅛, and represented by numeral 18. Therefore, a socket of this particular size can easily fit within the confines of the opening for storage purposes. The underside of the socket may rest on the tray immediately below while the upper portion of the socket is raised above the surface of the plate 14 so that it may be grasped by the fingers of the user in order to remove the socket from storage. Preferably, the diameter of each opening should be slightly larger so as to readily accommodate the diameter of the socket itself. Little clearance is necessary between the exterior of the socket and the edge of the plate defining the hole in order to accommodate insertion or removal of the socket. Preferably, the indicia carried on the flat planar surface or face of the plate 14 is raised so that the indicia is readily readable and, to some extent, available for finger location in selecting a hole opening.

Figure 3:
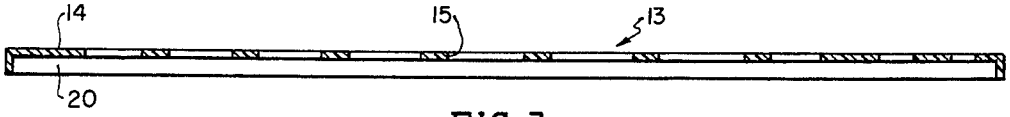
FIG. 3 is a longitudinal cross-sectional view of the tool caddy as shown in FIG. 1 as taken in the direction of arrows 3—3 thereof.

Referring now in detail to FIG. 3, it can be seen that the peripheral edge of the plate 14 includes a downwardly depending flange, identified by numeral 20, which serves as a stand-off for separating the underside of the plate 14 from a supporting surface such as the tool tray in the tool box. By this means, a space is defined underneath the plate for accommodating a portion of the length of each socket when it is stored in a respective opening or hole.

Figure 4:
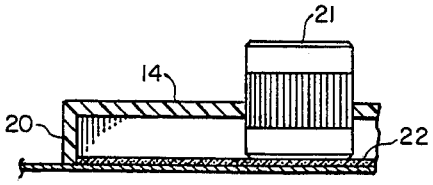
FIG. 4 is an enlarged cross-sectional fragmentary view of a socket disposed in the tool caddy and further including a magnetic panel for yieldably holding the socket in place.

Referring now in detail to FIG. 4, a socket 21 is illustrated as being stored within a hole or opening in the plate 14 and it can be seen that the stand-off 20 is resting on a supporting surface, such as the bottom of the tool tray. The illustration also shows a means for holding the sockets in their respective storage openings and in this instance, the means includes a pad, layer or panel of magnetic material as indicated by numeral 22. Such material produces a magnetic flux into which the lower portion of socket 21 is introduced when passed through the opening or hole. The magnetic flux yieldably holds the socket in position so that the user must exert a slight force in order to remove the socket from its storage position. In this manner, vibration or jarring of the tool box or tool caddy will not cause the sockets to dislodge from their storage position.

Figure 5:
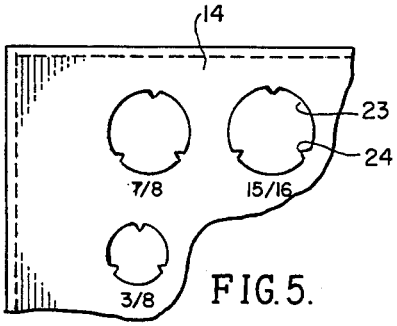
FIG. 5 is a fragmentary plan view of another embodiment of the present invention showing the tool caddy having yieldable nubs or flaps projecting into each opening to provide an interference fit with a socket when placed therein.

Another means for retaining sockets in their respective holes or openings is illustrated in FIG. 5 wherein each of the respective openings, such as opening 23, includes at least three nubs, tabs or other enlargements that will interfere with the placement or withdrawal of the socket from the opening. Such a flap or nub is indicated by numeral 24 and it is to be understood that the interference is yieldable and that-light finger pressure will readily overcome the interference so that the socket may be easily introduced into the opening or withdrawn therefrom. Preferably, the tabs or nubs are integral with the formation of the plate 14 and are sufficiently pliable to permit the interference fit with the socket.

The rows and columns of openings are divided into not only sizes such as ½ inch, ⅛ inch, ¾ inch or the like, but include the particular drive intended to be used, such as 12 point, 6 point or whichever drive is appropriate. The rows shown in FIG. 2 include such indicia as examples.

In view of the foregoing, it can be seen that a novel means is provided for arranging a variety of different sized sockets in a convenient manner so that they may be stored in a position not subject to dislodgement due to jarring or vibration. It can be seen that the means for retaining the sockets, whether it be the magnetic pad 22 or the nubs or tabs 24, represent yieldable or pliable members that may press against the exterior surface of the socket as it is introduced through the opening. In the case of the pad, the magnetic flux takes hold immediately, and in the case of the nubs or tabs, physical engagement produces a yieldable interfering fit.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A tool caddy apparatus for organizing a variety of different sized wrench sockets comprising:

a tool box having a tray therein, said tray having a bottom consisting a supporting surface;

a socket support member having a flat planar surfaced plate with a plurality of different sized openings provided within its perimeter;

said plate having a downwardly depending flange about its perimeter and terminating with an edge adapted to engage with said supporting surface;

retaining means associated with each of said plate openings for releasably holding a socket therein;

said retaining means includes at least three pliable elements carried on said plate at each of said openings and projecting in a plane defined by said plate into said openings to provide an interference fit with said socket;

said retaining means includes a magnetic layer disposed beneath said plate between portions of said flange and having a magnetic flux field occupying an area defined between the underside of said plate and said magnetic layer;

said plate includes indicia adjacent each of said openings for identifying that opening with a particular socket;

said indicia is raised above the upper surface of said plate augmenting its visual observance;

said plurality of openings are arranged substantially in rows and columns across said plate in fixed spaced-apart relationship.

* * * * *